US008568490B2

(12) United States Patent
Miyake et al.

(10) Patent No.: US 8,568,490 B2
(45) Date of Patent: Oct. 29, 2013

(54) LIQUID DETERGENT COMPOSITION

(75) Inventors: Toshio Miyake, Wakayama (JP); Hitoshi Ishizuka, Wakayama (JP); Kohei Nishida, Wakayama (JP); Ayako Kita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/129,590

(22) PCT Filed: Nov. 19, 2009

(86) PCT No.: PCT/JP2009/069991
§ 371 (c)(1),
(2), (4) Date: May 17, 2011

(87) PCT Pub. No.: WO2010/058862
PCT Pub. Date: May 27, 2010

(65) Prior Publication Data

US 2011/0224126 A1 Sep. 15, 2011

(30) Foreign Application Priority Data

Nov. 21, 2008 (JP) ..... 2008-298806
Aug. 21, 2009 (JP) ..... 2009-191791
Nov. 2, 2009 (JP) ..... 2009-252012

(51) Int. Cl.

| | |
|---|---|
| ***C11D 1/722*** | (2006.01) |
| ***C11D 1/02*** | (2006.01) |
| ***C11D 3/30*** | (2006.01) |
| ***C11D 3/43*** | (2006.01) |
| ***B08B 3/04*** | (2006.01) |

(52) U.S. Cl.
USPC ..... 8/137; 510/351; 510/356; 510/357; 510/360; 510/421; 510/426; 510/475; 510/499; 134/25.2; 134/25.3; 134/39; 134/42

(58) Field of Classification Search
USPC ..... 510/351, 356, 357, 360, 421, 426, 475, 510/499; 134/25.2, 25.3, 39, 42; 8/137
See application file for complete search history.

(56) References Cited

U.S. PATENT DOCUMENTS 6,007,584 A * 12/1999 Suzuki et al. ..... 8/139
6,140,296 A 10/2000 Ishii et al.

FOREIGN PATENT DOCUMENTS

| | | |
|---|---|---|
| EP | 0 882 785 A1 | 12/1998 |
| EP | 0 885 951 A2 | 12/1998 |
| JP | 8 157867 | 6/1996 |
| JP | 10 195499 | 7/1998 |
| JP | 10 324900 | 12/1998 |
| JP | 11 131091 | 5/1999 |
| JP | 11 310800 | 11/1999 |
| JP | 11 315299 | 11/1999 |
| JP | 2001 334139 | 12/2001 |
| JP | 2008 7705 | 1/2008 |
| JP | 2008 7706 | 1/2008 |
| JP | 2008 7707 | 1/2008 |
| JP | 2008 156607 | 7/2008 |
| WO | 98 24864 | 6/1998 |

OTHER PUBLICATIONS

English translation of the International Preliminary Report on Patentability and Written Opinion of the International Searching Authority issued Jul. 5, 2011, in PCT/JP2009/069991.
U.S. Appl. No. 13/257,509, filed Sep. 19, 2011, Ishizuka, et al.
International Search Report issued Jan. 12, 2010 in PCT/JP09/69991 filed Nov. 19, 2009.
Office Action issued on Jun. 27, 2012 in the corresponding Chinese Application No. 200980146696.6 (with English Translation).
Chinese Office Action mailed Feb. 25, 2013 in corresponding Chinese Patent Application No. 200980146696.6, with English Translation. (6 pp.).
Extended European Search Report mailed Mar. 18, 2013 in corresponding European Patent Application No. 09827643, 5 pp.

* cited by examiner

*Primary Examiner* — Brian P Mruk
(74) *Attorney, Agent, or Firm* — Oblon, Spivak, McClelland, Maier & Neustadt, L.L.P.

(57) ABSTRACT

The invention provides a liquid detergent composition containing (a) a nonionic surfactant obtained by adding ethylene oxide and an alkylene oxide with from 3 to 5 carbon atoms to a compound represented by R—OH (wherein R represents an alkyl group or an alkenyl group with from 8 to 18 carbon atoms) under a specified condition, (b) an anionic surfactant and (c) a water-miscible organic solvent in specified ratios, respectively.

16 Claims, No Drawings

LIQUID DETERGENT COMPOSITION

TECHNICAL FIELD

The present invention relates to a liquid detergent composition, further a liquid detergent composition for use in clothes and house and the like, especially fiber products such as clothes.

BACKGROUND ARTS

In recent years, awareness concerning environmental issues has increased, and the appearance of a detergent which is low in a load against the environment is being desired eagerly. It is thought that a detergent of a so-called concentrated type having a higher detergent component concentration than conventional detergents is very effective for decreasing the size of a detergent itself and reducing a load against the environment, for example, a reduction of the amount of a container resin, a reduction of the cost of transportation, a reduction of wastes after the use, etc.

JP-A 2008-7705,JP-A 2008-7706 and JP-A 2008-7707 disclose liquid detergent compositions of a concentrated type having a specified nonionic surfactant blended therein.

JP-A 8-157867 discloses a liquid detergent composition of a concentrated type in which a nonionic surfactant having ethylene oxide (EO) and propylene oxide (PO) added to a higher alcohol and a specified solvent are blended. In the specification and working examples thereof, a nonionic surfactant of an EO/PO block type obtained by adding EO and then adding PO is disclosed as a preferred nonionic surfactant.

WO-A 1998-024864 discloses a surfactant composition, having a high concentration, being excellent in handling, containing a nonionic surfactant (hereinafter, referred to as R-EPE nonion) in which ethylene oxide (EO), propylene oxide (PO) and further ethylene oxide (EO) are added in block in this order to a higher alcohol, and a liquid detergent composition containing the surfactant.

WO-A 1998-024865 discloses a surfactant composition, having a high concentration, being excellent in handling, containing the R-EPE nonion in which ethylene oxide (EO), propylene oxide (PO) and further ethylene oxide (EO) are added in block in this order to a higher alcohol and an anionic surfactant at a ratio of 99/1 to 10/90, and a liquid detergent composition containing the surfactant.

JP-A 10-195499 discloses a detergent for clothes, containing 10 to 50% by mass of the R-EPE nonion, being excellent in stability.

JP-A 11-310800 and JP-A 11-315299 disclose a liquid detergent containing the R-EPE nonion, an anionic surfactant and other components.

SUMMARY OF THE INVENTION

The present invention relates to a liquid detergent composition containing the following components (a) to (c), wherein the total sum of the contents of the components (a) and (b) is from 50 to 90% by mass in terms of [(a)+(b)], and a mass ratio of component (a) to component (b) is from 25/75 to 90/10 in terms of (a)/(b):

Component (a): from 15 to 75% by mass of a nonionic surfactant, obtained by adding p1 moles of ethylene oxide to a compound represented by R—OH (wherein R represents an alkyl group or an alkenyl group with from 8 to 18 carbon atoms), then adding q1 moles of an alkylene oxide with from 3 to 5 carbon atoms and further adding p2 moles of ethylene oxide, wherein p1 represents a number of from 3 to 30, q1 represents a number of from 1 to 5 and (p1+p2) is from 14 to 50;

Component (b): an anionic surfactant; and

Component (c): from 5 to 40% by mass of a water-miscible organic solvent.

A liquid detergent composition containing the following components (a) to (c), wherein the total sum of the contents of the components (a) and (b) is from 50 to 90% by mass in terms of [(a)+(b)], and a mass ratio of component (a) to component (b) is from 25/75 to 90/10 in terms of (a)/(b):

Component (a): from 15 to 75% by mass of a nonionic surfactant, obtained by adding p1 moles of ethylene oxide to a compound represented by R—OH (wherein R represents an alkyl group or an alkenyl group with from 8 to 18 carbon atoms), then adding q1 moles of an alkylene oxide with from 3 to 5 carbon atoms and further adding p2 moles of ethylene oxide, wherein p1 represents a number of from 3 to 30, q1 represents a number of from 1 to 5, (p1+p2) is from 14 to 50, and p1/(p1+p2) is from 0.2 to 0.8;

Component (b): an anionic surfactant; and

Component (c): from 5 to 40% by mass of a water-miscible organic solvent.

Further, the present invention provides a method of washing, including applying the above shown liquid detergent composition to an object to wash and use of the above shown liquid detergent composition as a detergent.

DETAILED DESCRIPTION OF THE INVENTION

In usual liquid detergents, when the concentration of a surfactant which is a detergent component is increased (for example, 50% by mass or more), there is involved a problem that thickening or gelation occurs, thereby remarkably impairing the use properties. This is because a phase where the viscosity is remarkably high, such as liquid crystals or crystals, is formed in the composition due to the increase in concentration of the surfactant. Also, in such a system with a high concentration of the surfactant, there is generally known a method for obtaining a low-viscosity composition by blending a large amount of a solvent, a solubilizing agent or the like. However, there are involved problems in solubility and stability, for example, as a composition is diluted with water at the time of dilution with water, especially cold water, the diluted composition forms a liquid crystal, thereby causing inferior dissolution; and as the concentration of the surfactant increases, the composition is easily solidified at the time of low-temperature storage.

None of the above shown publications suggests a surfactant or a combination of surfactants, optimized from the viewpoint that a deterging powder as an essential property for a liquid detergent is increased and problems in solubility and stability are solved. The above-mentioned composition of JP-A 2008-7705, JP-A 2008-7706 and JP-A 2008-7707 shows a sufficient studying about stability and a low temperature solubility. JP-A 8-157867 fails to show a relation between an increased detergency and a surfactant. JP-A8-157867 refers to a low temperature solubility with evaluation thereof attained by adding a liquid detergent to a large amount of water and stirring it, but fails to show stirring conditions. No sufficient studying about the low temperature solubility is disclosed there and actually disclosed compositions have no sufficient solubility at a low temperature. WO-A1998-024864, WO-A 1998-024865, JP-A 10-195499, JP-A 11-310800 and JP-A 11-315299 shows use of R-EPE nonion. But they fail to show concretely a high concentration surfactant type liquid detergent composition containing a surfactant at a high concentration such as larger than 50 mass %, and resulting effects thereof.

The present invention provides a liquid detergent composition, which is excellent in detergency and storage stability and free from lowering of solubility to be caused due to gel formation during dilution of the composition with water, in a liquid detergent composition containing a surfactant at a high concentration, having a decreased size of the detergent, being very useful in decreased load to ecology such as a saved amount of a container's resin, a saved cost of transportation and a saved amount of waist after use.

Nevertheless while the composition of the invention contains a surfactant as a detergent component at a high concentration, it is excellent instability, especially storage stability at a low temperature, excellent in solubility, especially solubility in cold water and also excellent in detergent performance. The liquid detergent composition of the invention is excellent for clothes, house appliance, and especially fabric product such as clothes.

<Component (a)>

Component (a) of the invention is a nonionic surfactant obtained by adding p1 moles of ethylene oxide to one mole of a compound represented by R—OH (wherein R represents an alkyl group or an alkenyl group with from 8 to 18 carbon atoms), then adding q1 moles of an alkylene oxide with from 3 to 5 carbon atoms and further adding p2 moles of ethylene oxide. In view of stability and detergency, R is an alkyl group or an alkenyl group with from 8 to 18 carbon atoms, and preferably from 8 to 16 carbon atoms; and in view of detergency, it is preferable that the oxygen atom bound to R is bound to a first carbon atom or a second carbon atom of R. Component (a) can be obtained by adding an alkylene oxide to a primary alcohol or a secondary alcohol. R is preferably an alkyl group and is also preferably linear. As a raw material for obtaining a compound having such R, it is preferred to use, as the primary alcohol, an alcohol derived from natural fats and oils and, as the secondary alcohol, a synthetic alcohol. In case of using an alcohol derived from natural fats and oils, R is in general constituted of an even-numbered carbon atom number of from 8 to 18 and may be constituted in terms of alkyl distribution of a natural fatty acid. However, in the invention, it is especially preferable that at least one linear alkyl group selected from an alkyl group with 10 carbon atoms, an alkyl group with 12 carbon atoms and an alkyl group with 14 carbon atoms is included. Since p1, p2 and q1 each represents an addition molar number per mole of the compound represented by R—OH, these will be hereunder sometimes described in terms of an average addition molar number.

Component (a) of the invention can be expressed as a nonionic surfactant represented by the following general formula (I).

$$RO(EO)_{p1}(AO)_{q1}(EO)_{p2}H \quad (I)$$

[In the formula, R represents an alkyl group or an alkenyl group with from 8 to 18 carbon atoms; EO represents an oxyethylene group; AO represents an oxyalkylene group with from 3 to 5 carbon atoms; p1 and p2 each represents an average addition molar number of EO; p1 represents a number of from 3 to 30; and q1 represents an average addition molar number of AO and is a number of from 1 to 5. Also, (p1+p2) is from 14 to 50.]

The nonionic surfactant can be expressed as a nonionic surfactant represented by the following general formula (Ia).

$$RO(EO)_{p1}(AO)_{q1}(EO)_{p2}H \quad (Ia)$$

[In the formula, R represents an alkyl group or an alkenyl group with from 8 to 18 carbon atoms; EO represents an oxyethylene group; AO represents an oxyalkylene group with from 3 to 5 carbon atoms ; p1 and p2 each represents an average addition molar number of EO; p1 represents a number of from 3 to 30; and q1 represents an average addition molar number of AO and is a number of from 1 to 5. Also, (p1+p2) is from 14 to 50 and p1/(p1+p2) is 0.2 to 0.8.]

The present invention is a liquid detergent composition containing the following components (a) to (c), wherein the total sum of the contents of the components (a) and (b) is from 50 to 90% by mass in terms of [(a)+(b)], and a mass ratio of component (a) to component (b) is from 25/75 to 90/10 in terms of (a)/(b):

Component (a): from 15 to 75% by mass of a nonionic surfactant represented by the formula (I)

$$RO(EO)_{p1}(AO)_{q1}(EO)_{p2}H \quad (I)$$

[In the formula, R represents an alkyl group or an alkenyl group with from 8 to 18 carbon atoms; EO represents an oxyethylene group; AO represents an oxyalkylene group with from 3 to 5 carbon atoms; p1 and p2 each represent an average addition molar number of EO; p1 represents a number of from 3 to 30; and q1 represents an average addition molar number of AO and is a number of from 1 to 5. Also, (p1+p2) is from 14 to 50.];

Component (b): an anionic surfactant; and

Component (c): from 5 to 40% by mass of a water-miscible organic solvent.

In component (a), the p1 of the average addition molar number of the oxyethylene group (hereinafter sometimes referred to as "EO group") is from 3 to 30, preferably from 7 to 30, and more preferably from 8 to 20. Also, the average addition molar number p2 of the EO group is a number such that (p1+p2) is from 14 to 50, preferably from 3 to 30, more preferably 7 to 30, and further preferably from 8 to 20 relative to p1 falling within such a range.

In component (a), the total sum (p1+p2) of the average addition molar number of the EO group is from 14 to 50, preferably from 16 to 30, and more preferably from 16 to 25, even more preferably 18 to 25. When (p1+p2) is 14 or more, preferably 16 or more, more preferably 18 or more, the formation of a liquid crystal at a low temperature is inhibited, and the solubility is good. It is thought the size of the hydrophilic group moiety of the surfactant is larger than the size of the hydrophobic group moiety so that the alignment of the surfactant is inhibited. Also, when (p1+p2) is not more than 50, preferably not more than 30, more preferably not more than 25, the detergent performance and the solubility at a low temperature are satisfactory.

Also, in component (a), the average addition molar number q1 of the oxyalkylene group with from 3 to 5 carbon atoms (hereinafter sometimes referred to as "AO group") is from 1 to 5, preferably from 2 to 4, and more preferably from 2 to 3.

The average addition molar number q1 of the AO group is not less than the foregoing lower limit value, because a liquid crystal's or crystal's formation-inhibiting ability, solubility and stability at a low temperature are excellent, and is not more than the foregoing upper limit value for detergency. The AO group is obtained by adding an alkylene oxide with from 3 to 5 carbon atoms (hereinafter sometimes referred to as "AO"). It is known that the AO group is not only common in having a branched alkyl group, but forms a hydrophilic group with an blocked EO. On the other hand, it is known that the AO group exhibits oleophilicity. Of the AO groups, an oxyalkylene group with 3 carbon atoms, namely an oxypropylene group (hereinafter sometimes referred to as "PO group") is preferable in view of not only wide use but easiness of a subsequent addition reaction of ethylene oxide (hereinafter sometimes referred to as "EO"). That is, AO group is preferably an oxypropylene group.

Also, in component (a) of the invention, a ratio of the average addition molar numbers p1 and p2 of EO is from 0.2 to 0.8, and preferably from 0.3 to 0.7 in terms of p1/(p1+p2), as indication showing locations of EP and PO. When p1/(p1+p2) is 0.2 or more, the solubility and the stability at a low temperature are excellent because the liquid crystal or crystal formation-inhibiting ability is improved. Also, when p1/(p1+p2) is not more than 0.8, the stability at a low temperature is excellent because the crystal formation-inhibiting ability is improved.

Component (a) has a structure in which EO is added to R—O— as shown in the general formula (I). On that occasion, in view of the fact that the average addition molar number p1 is 3 or more, the proportion of the compound in which a group bound to RO— is the EO group is high. On the other hand, component (a) has a structure of -EO-H in the terminal thereof as shown in the general formula (I). On that occasion, in view of the fact that the average addition molar number p2 is from 14 to 50 in terms of (p1+p2), the proportion of the compound in which the terminal thereof is -EO-H is high. In the invention, the proportion of the compound in which EO is bound to R—O— [hereinafter sometimes referred to as "component (a-i)"] is preferably 75% by mole or more, and more preferably 80% by mole or more relative to the nonionic surfactant constituting the general formula (I). Also, the proportion of the compound in which a structure of the terminal thereof which is viewed from R is -EO-H [hereinafter sometimes referred to as "component (a-ii)"] is preferably 70% by mole or more, and more preferably 80% by mole or more relative to the nonionic surfactant constituting the general formula (I). When the proportion of component (a-i) is 75% by mole or more, since the liquid crystal or crystal formation-inhibiting ability is enhanced, the solubility and the stability at a low temperature are excellent. Also, when the proportion of component (a-ii) is 70% by mole or more, since the crystal formation-inhibiting ability is enhanced, the stability at a low temperature is excellent. In the invention, the proportion of each of the foregoing components (a-i) and (a-ii) can be determined by means of quantitative measurement using $C^{13}$-NMR.

Component (a) can contain 75% by mole or more, more preferably 80% by mole or more, of component (a-i), by adding 6 moles or more, especially 8 moles or more, as p1 of ethylene oxide, relative to R—OH, at the presence of an alkali catalyst. Component (a) can contain 70% by mole or more, more preferably 80% by mole or more, of component (a-ii) by adding p1 moles of ethyleneoxide, continuously adding q1 moles of an alkyleneoxide having 3 to 5 carbon atoms and adding 6 moles or more, especially 8 moles or more as p2 of ethyleneoxide at p2.

The characteristic feature of the invention resides in the matter that, in a liquid detergent composition containing a surfactant in a high concentration, namely a liquid detergent composition having a surfactant concentration of 50% by mass or more, and especially 60% by mass or more, by blending an organic solvent in a specified ratio together with an anionic surfactant as a component (b) as described later, not only excellent stability and detergency are realized, but hindrance of solubility to be caused due to the gelation at the time of dissolution in water is successfully inhibited. This resides in the point of finding that such a feature largely relies upon component (a) and that it is possible to reduce a region of a liquid crystal phase of a three-component phase diagram of water-surfactant-solvent by component (a). In component (a) which is used in the invention, the average addition molar number of each of the EO group and the AO group is specified, and it is noted that, as compared with nonionic surfactants of an AO addition type which are generally used for household detergents for use in clothes, this is characteristic in the points of a large total addition molar number of EO and symmetry of the molar number of EO. In general, in case of preparing a liquid detergent containing a nonionic surfactant as a main base material, in a polyoxyethylene alkyl ether which is a well known nonionic surfactant, when the average addition molar number of EO exceeds 14, the detergency is lowered. Usually, in case of a detergent for use in clothes, the average EO addition molar number which is favorable for the detergency is from about 3 to 12. However, in the conventional nonionic surfactant, when used in a high-concentration surfactant system, gelation takes place during the dilution, and the problem regarding solubility cannot be solved. In the invention, by specifying the compound which has an average EO addition molar number of 14 or more and in which a hydrophobic oxyalkylene group, namely an oxyalkylene group with from 3 to 5 carbon atoms, preferably an oxypropylene group is present between the EO groups (inclusive of a polyoxyethylene group) and further adding a component (b) as described later in a portion of (a)/(b) of from 25/75 to 90/10 in terms of a mass ratio, the problems regarding low-temperature stability and gelation at the time of dissolution in cold water have been successfully solved.

It is considered that the addition of EO, PO and EO in this order in the specified average addition molar numbers to R—OH increases, as before mentioned, the proportion of component (a-i) or component (a-ii) in component (a). It is estimated that this also contributes to improvement in effects of the invention by controlling regions of a crystal phase or a liquid crystal phase or the like.

As to the production of component (a), examples of a catalyst which is used for the alkoxylation of R—OH include base catalysts and acid catalysts. Of these, base catalysts are especially preferably used from cost viewpoint. It is the most preferable that potassium hydroxide is used as the base.

One example of the production condition in case of using potassium hydroxide as the catalyst is hereunder described. First of all, after charging potassium hydroxide into a saturated or unsaturated higher alcohol with from 8 to 18 carbon atoms which is a raw material (the compound represented by R—OH), the system is purged with nitrogen, and the mixture is dehydrated at from 100 to 110° C. and at from 1 to 7 kPa for from 30 minutes to one hour. Subsequently, EO is added at from 100 to 170° C. and at from 0.3 to 0.6 MPa; subsequently, AO, preferably propylene oxide is added under a condition at from 100 to 150° C. and at from 0.3 to 0.7 MPa; EO is again added under a condition at from 100 to 170° C. and at from 0.3 to 0.7 MPa; and the reaction mixture is then neutralized with an acid agent (for example, acetic acid, lactic acid, glycolic acid, etc.) in an equimolar amount to the added potassium hydroxide, thereby obtaining component (a). The use amount of each of EO and AO is chosen depending upon the molar number of the raw material alcohol so as to meet the requirements regarding the average values of p1, q1 and q2 in the composition.

In the liquid detergent composition of the invention, the blending amount of component (a) is from 15 to 75% by mass, preferably from 25 to 60% by mass, and especially preferably from 35 to 50% by mass. From the viewpoint of detergent performance in a used small amount by compacting, the amount is not less than the lower limit. From the viewpoint of stability and solubility, it is not more than the upper limit.

<Component (b)>

In view of enhancing the detergent performance, stability and solubility, an anionic surfactant (b) is blended in the liquid detergent composition of the invention. It is necessary that the content of component (b) is satisfied with a ratio as described later in relation to component (a). Component (b) has an effect as a detergent component and when used with component (a) in a specified ratio, enhances the stability and solubility in addition to effects as a detergent component. While the reason for this has not been elucidated yet, it is expected that when a molecule of component (b) is mixed between the molecules of component (a), alignment of the molecule of the surfactant is inhibited due to electrical repulsion of the anionic group of component (b), resulting in inhibiting the formation of a liquid crystal or a crystal.

As the anionic surfactant, for example, the following (b1) to (b5) can be used. In view of detergent performance, stability and solubility, (b1), (b2) or (b4) is preferably contained, and at least one of (b1) and (b2) is more preferably contained. When at least one of (b1) and (b2) is contained, it occupies preferably 80% by mass or more, more preferably 90% by mass or more, of component (b), from the viewpoint of detergency, low-temperature stability and solubility. Further, in the case where (b4) is contained for the reasons of an effervescence controlling agent, a mud dispersant, etc, (b4) is contained preferably in an amount of from 1 to 30% by mass, more preferably from 1 to 20% by mass, in component (b) in view of low-temperature stability.

(b1) Alkylbenzene sulfonic acid salts having an alkyl group with from 10 to 20 carbon atoms in average (b2) Polyoxyethylene alkyl ether sulfuric acid ester salts, having an alkyl group derived from a linear primary alcohol or a linear secondary alcohol or an alkyl group derived from a branched alcohol, having 10 to 20 carbon atoms on the average, having an oxyalkylene group in an average addition molar number of from 1 to 5, the oxyalkylene group containing oxyethylene group, optionally containing oxypropylene group in an average addition molar number of from 0.2 to 2.

(b3) Alkyl or alkenyl sulfuric acid ester salts having an alkyl group or an alkenyl group with from 10 to 20 carbon atoms in average (b4) Fatty acid salts with from 8 to 20 carbon atoms in average (b5) Polyoxyethylene alkyl ether carboxylic acid ester salts, having an alkyl group derived from a linear primary alcohol or a linear secondary alcohol or an alkyl group derived from a branched alcohol, having 10 to 20 carbon atoms on the average, having an oxyalkylene group in an average addition molar number of from 1 to 5, the oxyalkylene group containing oxyethylene group, optionally containing oxypropylene group in an average addition molar number of from 0.2 to 2.

Examples of the salt constituting component (b) include alkali metal salts of sodium, potassium, etc.; alkanolamine salts; and alkaline earth metal salts of magnesium, calcium, etc. Of these, from the viewpoint of stability, alkanolamine salts are preferable. The anionic surfactant maybe added in an acid form to the liquid detergent and neutralized with an alkali in the system. In the invention, it is preferable that component (b) is an alkanolamine salt, or is added in an acid form and neutralized with an alkanolamine [an alkanolamine to be used as an alkaline agent as a component (f) as described later]. A counter ion of a metal such as an alkali metal or an alkaline earth metal is possibly contained, through the production step of component (a) or as a salt of a metal ion-sequestering agent or an other anionic compound, or it is possibly contained as an antioxidant for the composition, such as sodium sulfite as a color-preventing agent in an amount range shown below. The amount of the counter ion is preferably small, substantially preferably not more than 5% by mass, especially preferably not more than 3% by mass.

In the liquid detergent composition of the invention, from the viewpoint of detergency, the total sum [(a)+(b)] of the contents of the components (a) and (b) is from 50 to 90% by mass, preferably from 50 to 80% by mass, and especially preferably from 50 to 70% by mass. From the viewpoint of detergent performance in a used small amount by compacting, the amount is not less than the lower limit. From the viewpoint of stability and solubility, it is not more than the upper limit. The mass of the anionic surfactant as component (b) varies depending upon the molecular weight of the salt. Thus, in the invention, the mass when not the salt, but the acid form, namely the counter ion, is assumed as a hydrogen atom ion, is defined as a mass of component (b).

Also, in the liquid detergent composition of the invention, from the viewpoints of detergent performance, solubility and stability, a mass ratio of (a)/(b) is from 25/75 to 90/10, preferably from 50/50 to 80/20, and more preferably from 60/40 to 80/20. In view of detergency, the proportion of component (a) is the lower limit value or more; and from the viewpoints of solubility and stability, the proportion of component (a) is not more than the upper limit value. According to the joint use with component (b), component (a) is able to increase the detergency of the composition and further to increase the solubility upon inhibiting the formation of a liquid crystal.

<Component (c)>

In view of enhancing the stability and solubility, the liquid detergent composition of the invention contains a water-miscible organic solvent (c) in an amount of from 5 to 40% by mass. The water-miscible organic solvent as referred to in the invention refers to a solvent which is dissolved in an amount of 50 g or more in 1 L of ion exchanged water at 25° C., namely a solvent with a degree of dissolution of 50 g/L or more.

In view of stability and solubility, the content of component (c) is from 5 to 40% by mass, preferably from 10 to 35% by mass, and especially preferably from 10 to 25% by mass in the composition. Also, from the viewpoints of stability and solubility, a mass ratio of the total sum of the components (a) and (b) to component (c) [{(a)+(b)}/(c)] is preferably from 90/10 to 65/35, more preferably from 85/15 to 70/30, and further preferably from 80/20 to 70/30.

In view of detergent performance, stability and solubility, a water-miscible organic solvent having a hydroxyl group and/or an ether group is preferable as component (c).

Examples of the water-miscible organic solvent include (c1) an alkanol such as ethanol, 1-propanol, 2-propanol or 1-butanol; (c2) an alkylene glycol having 2 to 6 carbon atoms such as ethylene glycol, propylene glycol, butylene glycol or hexylene glycolor glycerin; (c3) a polyalkylene glycol such as diethylene glycol, triethylene glycol, tetraethylene glycol, dipropylene glycol, tripropylene glycol or a polyalkylene glycol having an alkylene glycol unit having 2 to 4 carbon atoms, such as polyethylene glycol or polypropylene glycol, having a weight-average molecular weight of 400 to 4000; (c4) (poly)alkylene glycol (mono- or di-)alkyl ether, composed of (poly) alkylene glycol having alkylene glycol unit having 2 to 4 carbon atoms and alkanol having 1 to 5 carbon atoms, such as diethylene glycol monomethyl ether, diethylene glycol dimethyl ether, triethylene glycol monomethyl ether, diethylene glycol monoethyl ether, diethylene glycol diethyl ether, dipropylene glycol monomethyl ether, dipropylene glycol monoethyl ether, tripropylene glycol monomethyl ether, diethylene glycol monobutyl ether, 1-methoxy-2-propanol or 1-ethoxy-2-propanol; (c5) an alkylglyceryl ether having a C1 to C8 alkyl, such as 1-methylglyceryl ether, 2-methylglyceryl ether, 1,3-dimethylglyceryl ether, 1-ethylglyceryl ether, 1,3-diethylglyceryl ether, triethylglyceryl ether, 1-pentylglyceryl ether, 2-pentylglyceryl ether, 1-octylglyceryl ether or 2-ethylhexylglyceryl ether; and (c6) an aromatic ether of (poly)alkylene glycol having alkylene glycol unit having 2 to 3 carbon atoms, such as 2 -phenoxyethanol, diethylene glycol monophenyl ether, triethylene glycol monophenyl ether, polyethylene glycol monophenyl ether having an average molecular weight of about 480 or 2-benzyloxyethanol, diethylene glycol monobenzyl ether.

Component (c) is effective as a viscosity modifier or a gelation inhibitor for the composition. One or more members selected from the above shown (c1) to (c6) may be used. Two or more selected from the alkanols (c1), the glycols (c2), the alkyl ethers (c4) and the aromatic ethers (c6) are preferably used in combination. Two or more selected from the glycols (c2), the alkyl ethers (c4) and the aromatic ethers (c5) are more preferably used in combination. Two or more selected from the glycols (c2), the alkyl ethers (c4) and the aromatic ethers (c6), more specifically two or more selected from propylene glycol, diethylene glycol monobutyl ether and mono- to tri-ethylene glycol monophenyl ether, are more preferable used in combination to attain effectively the viscosity modification and the gelation inhibition of the composition.

<Component (d)>

In view of enhancing the stability and solubility, it is preferable that the liquid detergent composition of the invention contains, as a component (d), water in an amount of from 5 to 40% by mass, and more preferably from 10 to 30% by mass. It is preferred to use water which does not affect the composition, such as deionized water described as ion exchange water.

<Other Components>

[Component (e)]

The liquid detergent composition of the invention can contain a surfactant other than the components (a) and (b) [hereinafter referred to as "component (e)"] so far as the effects of the invention are not impaired. Examples of component (e) include the following (e1) to (e3).

(e1) Nonionic Surfactants Not Corresponding to Component (a)

Examples thereof include the following (e1-1) and (e1-2).

(e1-1) Alkyl polysaccharide surfactants represented by the following general formula.

$$R^{1e}—(OR^{2e})_xG_y$$

[In the formula, $R^{1e}$ represents a linear or branched alkyl group or alkenyl group with from 8 to 18 carbon atoms; $R^{2e}$ represents an alkylene group with from 2 to 4 carbon atoms; G represents a residue derived from a reducing sugar and having 5 or 6 carbon atoms; x represents a number of from 0 to 6 in average; and y represents a number of from 1 to 10 in average.]

(e1-2) Fatty acid alkanolamides or polyhydroxy fatty acid amides (e2) Cationic Surfactants Examples thereof include cationic surfactants which are primary to tertiary amines having a long chain alkyl group (provided that alkanolamines as described later are excluded), and preferably those having one or two alkyl groups with from 8 to 22 carbon atoms, which may have an ether bond, an ester bond or an amide bond on the way, with the remainder being a hydrogen atom or an alkyl group having not more than 4 carbon atoms, which may have a hydroxyl group. In the invention, quaternary ammonium type surfactants having one long chain alkyl group with from 8 to 22 carbon atoms and tertiary amines having one long chain alkyl group with from 8 to 22 carbon atoms are preferable.

(e3) Ampholytic Surfactants

Examples thereof include sulfobetains and carbobetains each having an alkyl group with from 10 to 18 carbon atoms.

The content of component (e) is preferably from 0.5 to 15% by mass, and more preferably from 0.5 to 10% by mass in the liquid detergent composition of the invention. As to component (e), it is preferable that the nonionic surfactant (e1) falls within the range of the foregoing mass ratio of (a)/(b) in terms of [{(a)+(e1)}/(b)], including component (a). Also, as to the quaternary ammonium salt, the mass excluding a counter anion is defined as a mass of the quaternary ammonium salt; and as to the tertiary amine, the mass of a structure in which, of the groups bound to the nitrogen atom, a group or groups other than the organic group are substituted with a hydrogen atom, is defined as a mass of the tertiary amine.

[Alkaline Agent (f)]

It is preferable that an alkaline agent [hereinafter referred to as "component (f)"] is blended in the liquid detergent composition of the invention. Examples of the alkaline agent include, in addition to alkali metal hydroxides, alkali metal carbonates and so on, alkanolamines having from 1 to 3 alkanol groups with from 2 to 4 carbon atoms, which are general in liquid detergents. Of these, alkanols having a hydroxyethyl group are preferable. Besides the alkanol group of alkanol amine, a hydrogen atom is present, but those having a methyl group can be used as the alkaline agent. Examples of the alkanolamine include alkanolamines, for example, 2-aminoethanol, N-methylethanolamine, N,N-dimethylethanolamine, N,N-diethylethanolamine, diethanolamine, N-methyldiethanolamine, N-butyldiethanolamine, triethanolamine, triisopropanolamine, isopropanolamine mixtures (mixtures of mono-, di- and tri-), etc. In the invention, monoethanolamine and triethanolamine are the most preferable.

Component (f) can be used as a pH adjustor as described later. Also, component (f) may be blended as a counter salt to component (b).

The liquid detergent composition of the invention contains component (f) in an amount of preferably from 0.5 to 8% by mass, and more preferably from 1 to 7% by mass. Above of all, an alkanolamine is preferably contained as component (f) in an amount of from 0.5 to 8% by mass, and more preferably from 1 to 7% by mass.

Other components which can be further used in the invention are hereunder described.

[Component (g)]

The liquid detergent composition of the invention can contain a chelating agent [hereinafter sometimes referred to as "component (g)"]. As the chelating agent as component (g), known chelating agents which are used in liquid detergents can be used. Examples thereof include amino-polyacetic acids, for example, nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraminehexaacetic acid, djenkolic acid, etc., or salts thereof; organic acids, for example, diglycolic acid, oxydisuccinic acid, carboxymethyloxysuccinic acid, citric acid, lactic acid, tartaric acid, oxalic acid, malic acid, oxydisuccinic acid, gluconic acid, carboxymethylsuccinic acid, carboxymethyltartaric acid, etc., or salts thereof; and aminotri(methylenephosphonic acid), 1-hydroxyethylidene-1,1-diphosphonic acid, ethylenediaminetetra(methylenephosphonic acid), diethylenetriaminepenta(methylenephosphonic acid), or alkali metal or lower amine salts thereof. In the invention, it is preferable that the alkanolamine exemplified in the foregoing component (b) is converted into a salt, and the salt may be a salt obtained by blending an acid and then neutralizing it with an alkaline agent in the system.

In the case where component (g) is considered to be an acid form, its blending amount in the composition is from 0.1 to 5% by mass, preferably from 0.1 to 4% by mass, and more preferably from 0.1 to 3% by mass.

[Other Components]

In addition, the following components (i) to (xii) can be blended in the liquid detergent composition of the invention so far as the effects of the invention are not impaired.

(i) Soil redeposition preventing agents and dispersants, for example, polyacrylic acid, polymaleic acid, carboxymethyl cellulose, polyethylene glycol having a weight average molecular weight of 5,000 or more, a maleic anhydride-diisobutylene copolymer, a maleic anhydride-methyl vinyl ether copolymer, a maleic anhydride-vinyl acetate copolymer, a naphthalenesulfonic acid salt formalin condensate, polymers disclosed in claims 1 to 21 of JP-A-59-62614 (page 1, column 3, line 5 to page 3, column 4, line 14)

(ii) Color-migration preventing agents, for example, polyvinylpyrrolidone, etc.

(iii) Bleaching agents, for example, hydrogen peroxide, sodium percarbonate, sodium perborate, etc.

(iv) Bleach activators, for example, tetraacetylethylenediamine, bleach activators represented by the general formulae (I-2) to (I-7) of JP-A-6-316700, etc.

(v) Enzymes, for example, cellulase, amylase, pectinase, protease, lipase, etc.

(vi) Enzyme stabilizers, for example, boron compounds, calcium ion sources (calcium ion supply compounds), hydroxy compounds, formic acid, etc.

(vii) Fluorescent dyes, for example, commercially available fluorescent dyes such as TINOPAL CBS (a trade name, manufactured by Ciba Specialty Chemicals) or WHITEX SA (a trade name, manufactured by Sumitomo Chemical Co., Ltd.)

(viii) Antioxidants, for example, butyl hydroxytoluene, distyrenated cresol, sodium sulfite, sodium hydrogensulfite, etc.

(ix) Solubilizing agents, for example, p-toluenesulfonic acid, cumenesulfonic acid, m-xylenesulfonic acid, benzoic acid salts (also having an effect as an antiseptic), etc.

(x) Polyalkylene glycol based gelation preventing polymers, for example, polyethylene glycol having an average molecular weight of about 200, polyethylene glycol having an average molecular weight of about 400, polypropylene glycol having an average molecular weight of about 2,000, etc.

(xi) Water-immiscible organic solvents, for example, paraffins such as octane, decane, dodecane and tridecane, olefins such as decene and dodecene, alkyl halides such as methylene chloride and 1,1,1,-trichloroethane, terpenes such as D-limonene, etc.

(xii) Besides, coloring matters, perfumes, antifungal antiseptics, antifoaming agents such as silicone, etc.

In the case where each of the foregoing arbitrary components is blended in the liquid detergent composition of the invention, its concentration as an index is hereunder described. Such an arbitrary component is properly adjusted to an extent that the present effects are not impaired, and the case where it is not suitable for blending is excluded.

The content of the soil redeposition preventing agent and dispersant (i) is preferably from 0.01 to 10% by mass. The content of the color-migration preventing agent (ii) is preferably from 0.01 to 10% by mass. The content of the bleaching agent (iii) is preferably from 0.01 to 10% by mass. The content of the bleach activator (vi) is preferably from 0.01 to 10% by mass. The content of the enzyme (v) is preferably from 0.001 to 2% by mass. The content of the enzyme stabilizer (vi) is from 0.001 to 2% by mass. The content of the fluorescent dye (vii) is preferably from 0.001 to 1% by mass. The content of the antioxidant (viii) is preferably from 0.01 to 2% by mass. The content of the solubilizing agent (ix) is preferably from 0.1 to 2% by mass. The content of the polyalkylene glycol based gelation preventing polymer (x) is preferably from 0.01 to 2%. The content of the water-immiscible organic solvent (xi) is preferably from 0.001 to 2% by mass. The other components (xii) can be blended in, for example, known concentrations.

Of the foregoing arbitrary components, (ix), (x) and (xi) affect the stability of the liquid detergent composition, and therefore, attention must be paid especially in the blending thereof.

The pH value of the composition of the invention is measured at 25° C. according to JIS K 3362:1998. In view of detergent performance and stability, the pH of the composition of the invention is preferably from 6 to 11, and especially preferably from 8 to 10 (at 25° C.).

In view of easiness of handling, the viscosity of the liquid detergent composition of the invention at 20° C. is preferably from 10 to 500 mPa·s, more preferably from 50 to 400 mPa·s, and further preferably from 100 to 300 mPa·s. It is preferable that the viscosity is adjusted so as to fall within the foregoing range by component (c) or solubilizing agent.

Also, the liquid detergent composition of the invention is a composition in which gelation or high viscosity is not caused at the time of dilution with water. In consequence, specifically, in the liquid detergent composition of the invention, it is preferable that gelation is not caused in a step of diluting the composition with water at 5° C. within the range exceeding 0 time and up to 100 times at a temperature of the composition of from 5 to 40° C. A liquid detergent composition in which a diluted solution obtained in this dilution step has a viscosity of not more than 1,500 mPa·s at 5° C. is especially preferable.

In the invention, the viscosity is measured by a B-type viscometer. A rotor is chosen in conformity with the viscosity. The rotor is rotated at a rotation number of 60 r/min, and a viscosity 60 seconds after starting the rotation is defined as the viscosity of the liquid detergent composition or diluted solution.

The liquid detergent composition of the invention can be a liquid detergent article by charging a plastic container, for example, composed of a bottle and a lid with the function of dosage adjustment. For material of the bottle, polypropylene (PP), polyethylene terephthalate (PET), high-density polyethylene (HDPE), medium-density polyethylene (MDPE), polyvinyl chloride(PVC) can be used. As the container to charge with the liquid detergent composition of the invention, it is preferable from the view of prevention of deformation at a reduced pressure by a decreased inner pressure of a plastic-molded container that a plastic container has a liquid detergent composition-accommodating part and the liquid detergent composition-accommodating part is composed of a plastic having a modulus of elasticity in flexure (JIS K 7171) of 2000 Mpa or more, preferably 5000 Mpa or less, even more preferably 3000 Mpa or less, and a thickness of 0.3 mm to 1.5 mm. A bottle meeting such a modulus and such a thickness may be usually used. It is considered that the deformation of a container is caused by dissolution of oxygen, existing in a space of the bottle, because the liquid detergent composition of the invention contains a high content of a nonionic surfactant. Transmission of light promotes to dissolve oxygen in a liquid detergent composition containing a nonionic surfactant. In the invention a bottle having light-shielding is therefore preferably used. The dissolution of oxygen is much influenced by light having wave-lengths of 600 nm to 700 nm. The light transmittance is preferably 15% or less to the wavelengths. To improve the light shielding, titanium oxide or carbon black may be added to a plastic of the container.

The liquid detergent composition of the invention is preferably packed and sealed in a bag made by laminating flexible layered resin films, from the viewpoint of strange stability of the liquid detergent composition of the invention, for repacking.

Further, the bag is preferably provided at a top end with a nozzle part having a flowing out path. It is preferable that the nozzle part is processed with laser or scoring from the viewpoint of easy handling so that an opening part may be formed by opening the top end by hand. A shape of the bag is preferably a standing pouch type from the viewpoint of easy handling.

As film composed of a bag, a flexible single layer resin film may be used. A laminated resin film is usually used. Examples of a substrate of the laminated resin film include stretched nylon film (oriented nylon film) (ONy), polyethylene terephthalate (PET) or stretched polypropylene (OPP). Examples of sealant layer include non-stretched polypropylene (CPP), linear chain low density polyethylene (LLDPE), high density polyethylene (HDPE) and low density polyethylene (LDPE). Examples of barrier layer include aluminum-vaporized polyethylene terephthalate (VM-PET), ceramic-vaporized polyethylene terephthalate and aluminum foil.

Especially, a laminated resin film is preferably composed of three layers or more. It is preferable not to insert a printing ink layer between a medium layer and an innermost. Considering adaptability to production, strength to falling, an easy opening and a cost of wrapping material, it is especially preferable that a laminated film is laminated up in order of the following: from the outermost (the farthest layer from a layer being in contact with a liquid detergent composition), PET (preferably 9 to 25 μm of thickness)[ink layer+adhesive layer]/ONy(preferably 15 to 25 μm of thickness)/adhesive layer/LLDPE(preferably thickness of 60 to 200 μm).

The liquid detergent composition of the invention is suitable for the use in a fabric product such as clothes, bedclothes or fabrics.

EXAMPLES

The invention will be explained below in detail in line with examples. No limitation is made to the invention with the examples.

Respective components as shown in Table 1 to 3 were mixed to obtain compositions of the Examples and Comparative Examples. By using each of the obtained compositions, the following respective evaluations were carried out. The results are shown in Table 1 to 3.

(1) Evaluation of Detergency:

A cloth with collar dirt described in JIS K3362:1998 is prepared. Each of the liquid detergent compositions as shown in Table 1 and a detergency-determining index detergent were compared with respect to the detergency according to a detergency evaluation method of synthetic detergent for clothes described in JIS K3362:1998. The use concentration of the liquid detergent composition as shown in Table 1 to 3 was 0.33 g/L. The detergency was determined according to the criteria that the case where the detergency is superior to that of the index detergent is defined as "◎"; the case where the detergency is equal to that of the index detergent is defined as "○"; and the case where the detergency is inferior to that of the index detergent is defined as "X", respectively.

(2) Evaluation of Storage Stability:

A 50-mL sample bottle (a No. 6 standard wide-mouthed bottle which is made of glass and having a cylindrical shape of 40 mm in diameter and 80 mm in height) was charged with 40 mL of the liquid detergent composition and after being covered, was allowed to stand in a thermostatic chamber at 5° C. for 20 days. As to the stability of the composition, the appearance was visually observed and determined according to the following criteria.

○: A uniform liquid phase which is free from the formation of a liquid crystal or a crystal and is excellent in liquid stability.

X: A liquid crystal or a crystal is formed, or separation or deposition is found.

(3) Model Evaluation of Solubility:

The liquid detergent composition and ion exchanged water were mixed at intervals of 5% by mass such that [(mass of liquid detergent composition)/{(mass of liquid detergent composition)+(mass of ion exchanged water)}×100] was from 5 to 95% by mass, thereby preparing 19 samples in total. After allowing each of the samples in a thermostatic chamber at 5° C. for one day, the viscosity of the sample at 5° C. was measured under the following condition and determined according to the following criteria. This is a model test of solubility against water at 5° C.

Measurement unit: Digital B-type viscometer (Model: DV M-B), manufactured by Tokyo Keiki Inc.

Measurement condition: 60 r/min, 60 seconds

○: The viscosity of all of the samples is less than 1,500 mPa·s. This means that thickening by the formation of a liquid crystal or the formation of a crystal or the like is not caused at the time of dilution with cold water. Thus, it can be determined that the liquid detergent composition is excellent in solubility.

X: The samples include a sample or samples having a viscosity of 1,500 mPa·s or more. This means that there may be the case where thickening by the formation of a liquid crystal or the formation of a crystal or the like is caused at the time of dilution with cold water. Thus, it is determined that the liquid detergent composition is inferior in solubility.

XX: The samples above marked by "X" include samples having a viscosity of 2,000 mPa·s or more. This means that they may easily have an increased viscosity (thickening) by formation of a liquid crystal or formation of a crystal or the like at the time of dilution with cold water, considered to be poor at solubility, when they are diluted with cold water.

TABLE 1

| | | | | Example | | | | | |
|---|---|---|---|---|---|---|---|---|---|
| | | | | 1 | 2 | 3 | 4 | 5 | 6 |
| Liquid detergent composition | Blending component (mass %) | (a) | (a-1) | 50 | | | | | |
| | | | (a-2) | | 50 | | | | |
| | | | (a-3) | | | 50 | | | |
| | | | (a-4) | | | | 50 | | |
| | | | (a-5) | | | | | 50 | |
| | | | (a-6) | | | | | | 47 |
| | | | (a'-1) | | | | | | |
| | | | (a'-2) | | | | | | |
| | | | (a'-3) | | | | | | |
| | | | (a'-4) | | | | | | |
| | | | (a'-5) | | | | | | |
| | | | (a'-6) | | | | | | |
| | | | SOFTANOL 30 | | | | | | 3 |
| | | (b) | (b-1) | 18 | 18 | 18 | 18 | 18 | 15 |
| | | | (b-2) | | | | | | 1 |
| | | | (b-3) | | | | | | |
| | | | (b-4) | 1.5 | 1.5 | 1.5 | 1.5 | 1.5 | 1.5 |
| | | (c) | (c-1) | 10 | 10 | 10 | 10 | 10 | |
| | | | (c-2) | 4 | 4 | 4 | 4 | 4 | |
| | | | (c-3) | | | | | | 3 |
| | | | (c-4) | | | | | | 5 |
| | | (f) | Monoethanol amine | 4 | 4 | 4 | 4 | 4 | 5 |
| | | | Polymer (1) | | | | | | 0.05 |
| | | | Fluorescent dye | | | | | | 0.2 |
| | | | Enzyme | | | | | | 1 |
| | | | Coloring matter (1) | 0.0005 | 0.0005 | 0.0005 | 0.0005 | 0.0005 | 0.0005 |
| | | | Perfume | 1 | 1 | 1 | 1 | 1 | 1 |
| | | (d) | Ion exchanged water | Balance | Balance | Balance | Balance | Balance | Balance |
| | | | Total | 100 | 100 | 100 | 100 | 100 | 100 |
| | | | (p1 + p2) of component (a) | 18 | 14 | 50 | 18 | 18 | 17 |
| | | | q1 of component (a) | 2 | 2 | 2 | 2 | 2 | 2 |
| | | | p1/(p1 + p2) of component (a) | 0.5 | 0.5 | 0.5 | 0.22 | 0.77 | 0.5 |
| | | | (p1 + p2 + q1) of component (a) | 20 | 16 | 52 | 20 | 20 | 19 |
| | | | Proportion of (a-i) component in component (a) (% by mole) | 86 | 83 | 99 | 79 | 90 | 87 |
| | | | Proportion of (a-ii) component in component (a) (% by mole) | 92 | 87 | 99 | 95 | 75 | 93 |
| | | | (a) + (b) (mass %) | 69.5 | 69.5 | 69.5 | 69.5 | 69.5 | 67.5 |
| | | | (a)/(b) (mass ratio) | 50/19.5 | 50/19.5 | 50/19.5 | 50/19.5 | 50/19.5 | 50/17.5 |
| | | | (1) Evaluation of detergency | ◎ | ◎ | ○ | ◎ | ◎ | ◎ |
| | | | (2) Evaluation of storage stability | ○ | ○ | ○ | ○ | ○ | ○ |
| | | | (3) Model evaluation of solubility | ○ | ○ | ○ | ○ | ○ | ○ |

TABLE 2

| | | | | Example | | | | | |
|---|---|---|---|---|---|---|---|---|---|
| | | | | 7 | 8 | 9 | 10 | 11 | 12 |
| Liquid detergent composition | Blending component (mass %) | (a) | (a-1) | 40 | 60 | 45 | 50 | 45 | 40 |
| | | | (a-2) | | | | | | |
| | | | (a-3) | | | | | | |
| | | | (a-4) | | | | | | |
| | | | (a-5) | | | | | | |
| | | | (a-6) | | | | | | |
| | | | (a'-1) | | | | | | |
| | | | (a'-2) | | | | | | |
| | | | (a'-3) | | | | | | |
| | | | (a'-4) | | | | | | |
| | | | (a'-5) | | | | | | |
| | | | (a'-6) | | | | | | |
| | | | SOFTANOL 30 | | | | | | |
| | | (b) | (b-1) | 30 | 10 | | 18 | | 30 |
| | | | (b-2) | | | | | | |
| | | | (b-3) | | | 15 | | 15 | |
| | | | (b-4) | 1.5 | 1.5 | 1.5 | | | 1.5 |
| | | (c) | (c-1) | 10 | 10 | 10 | 10 | 10 | 10 |
| | | | (c-2) | 4 | 4 | 4 | 4 | 4 | 4 |
| | | | (c-3) | | | | | | |
| | | | (c-4) | | | | | | |
| | | (f) | Monoethanol amine | 4 | 4 | 6.6 | 4 | 6.6 | 6 |
| | | | Polymer (1) | | | | | | |

TABLE 2-continued

| | Example | | | | | |
|---|---|---|---|---|---|---|
| | 7 | 8 | 9 | 10 | 11 | 12 |
| Fluorescent dye | | | | | | |
| Enzyme | | | | | | |
| Dye (1) | 0.0005 | 0.0005 | 0.0005 | 0.0005 | 0.0005 | 0.0005 |
| Perfume | 1 | 1 | 1 | 1 | 1 | 1 |
| (d) Ion exchanged water | Balance | Balance | Balance | Balance | Balance | Balance |
| Total | 100 | 100 | 100 | 100 | 100 | 100 |
| (p1 + p2) of component (a) | 18 | 18 | 18 | 18 | 18 | 18 |
| q1 of component (a) | 2 | 2 | 2 | 2 | 2 | 2 |
| p1/(p1 + p2) of component (a) | 0.5 | 0.5 | 0.5 | 0.5 | 0.5 | 0.5 |
| p1 + p2 + q1 of component (a) | 20 | 20 | 20 | 20 | 20 | 20 |
| Proportion of (a-i) component in component (a) (% by mole) | 86 | 86 | 86 | 86 | 86 | 86 |
| Proportion of (a-ii) component in component (a) (% by mole) | 92 | 92 | 92 | 92 | 92 | 92 |
| (a) + (b) (mass %) | 71.5 | 71.5 | 64.5 | 68 | 64.5 | 71.5 |
| (a)/(b) (mass ratio) | 40/31.5 | 60/11.5 | 45/19.5 | 50/18 | 45/18 | 40/31.5 |
| (1) Evaluation of detergency | ◎ | ◎ | ◎ | ◎ | ◎ | ◎ |
| (2) Evaluation of storage stability | ○ | ○ | ○ | ○ | ○ | ○ |
| (3) Model evaluation of solubility | ○ | ○ | ○ | ○ | ○ | ○ |

TABLE 3

| | | | | Comparative example | | | | |
|---|---|---|---|---|---|---|---|---|
| | | | | 1 | 2 | 3 | 4 | 5 |
| Liquid detergent composition | Blending component (mass %) | (a) | (a-1) | 66 | 30 | 50 | | |
| | | | (a-2) | | | | | |
| | | | (a-3) | | | | | |
| | | | (a-4) | | | | | |
| | | | (a-5) | | | | | |
| | | | (a-6) | | | | | |
| | | | (a'-1) | | | | 50 | |
| | | | (a'-2) | | | | | 50 |
| | | | (a'-3) | | | | | |
| | | | (a'-4) | | | | | |
| | | | (a'-5) | | | | | |
| | | | (a'-6) | | | | | |
| | | | (a'-7) | | | | | |
| | | | SOFTANOL 30 | | | | | |
| | | (b) | (b-1) | 2 | 10 | 18 | 18 | 18 |
| | | | (b-2) | | | | | |
| | | | (b-3) | | | | | |
| | | | (b-4) | 1.5 | 1.5 | 1.5 | 1.5 | 1.5 |
| | | (c) | (c-1) | 10 | 10 | 4 | 10 | 10 |
| | | | (c-2) | 4 | 4 | | 4 | 4 |
| | | | (c-3) | | | | | |
| | | | (c-4) | | | | | |
| | | (f) | Monoethanol amine | 4 | 4 | 4 | 4 | 4 |
| | | | Polymer (1) | | | | | |
| | | | Fluorescent dye | | | | | |
| | | | Enzyme | | | | | |
| | | | Dye (1) | 0.0005 | 0.0005 | 0.0005 | 0.0005 | 0.0005 |
| | | | Perfume | 1 | 1 | 1 | 1 | 1 |
| | | (d) | Ion exchanged water | Balance | Balance | Balance | Balance | Balance |
| | | | Total | 100 | 100 | 100 | 100 | 100 |
| | | | (p1 + p2) of component (a) | 18 | 18 | 18 | 12 | 60 |
| | | | q1 of component (a) | 2 | 2 | 2 | 2 | 2 |
| | | | p1/(p1 + p2) of component (a) | 0.5 | 0.5 | 0.5 | 0.5 | 0.5 |
| | | | p1 + p2 + q1 of component (a) | 20 | 20 | 20 | 14 | 62 |
| | | | Proportion of (a-i) component in component (a) (% by mole) | 86 | 86 | 86 | 81 | 99 |
| | | | Proportion of (a-ii) component in component (a) (% by mole) (a-ii) | 92 | 92 | 92 | 83 | 99 |
| | | | (a) + (b) (mass %) | 69.5 | 41.5 | 69.5 | 69.5 | 69.5 |
| | | | (a)/(b) (mass ratio) | 66/3.5 | 30/11.5 | 50/19.5 | 50/19.5 | 50/19.5 |
| | | | (1) Evaluation of detergency | ◎ | X | ◎ | ◎ | X |
| | | | (2) Evaluation of storage stability | X | ○ | ○ | ○ | ○ |
| | | | (3) Model evaluation of solubility | X | ○ | X | X | X |
| | | | | XX | — | XX | XX | XX |

TABLE 3-continued

| | | | | Comparative example | | | | |
|---|---|---|---|---|---|---|---|---|
| | | | | 6 | 7 | 8 | 9 | 10 |
| Liquid detergent composition | Blending component (mass %) | (a) | (a-1) | | | | | |
| | | | (a-2) | | | | | |
| | | | (a-3) | | | | | |
| | | | (a-4) | | | | | |
| | | | (a-5) | | | | | |
| | | | (a-6) | | | | | |
| | | | (a'-1) | | | | | |
| | | | (a'-2) | | | | | |
| | | | (a'-3) | 50 | | | | |
| | | | (a'-4) | | 50 | | | |
| | | | (a'-5) | | | 50 | | |
| | | | (a'-6) | | | | 50 | |
| | | | (a'-7) | | | | | 50 |
| | | | SOFTANOL 30 | | | | | |
| | | (b) | (b-1) | 18 | 18 | 18 | 18 | 18 |
| | | | (b-2) | | | | | |
| | | | (b-3) | | | | | |
| | | | (b-4) | 1.5 | 1.5 | 1.5 | 1.5 | 1.5 |
| | | (c) | (c-1) | 10 | 10 | 10 | 10 | 10 |
| | | | (c-2) | 4 | 4 | 4 | 4 | 4 |
| | | | (c-3) | | | | | |
| | | | (c-4) | | | | | |
| | | (f) | Monoethanol amine | 4 | 4 | 4 | 4 | 4 |
| | | | Polymer (1) | | | | | |
| | | | Fluorescent dye | | | | | |
| | | | Enzyme | | | | | |
| | | | Dye (1) | 0.0005 | 0.0005 | 0.0005 | 0.0005 | 0.0005 |
| | | | Perfume | 1 | 1 | 1 | 1 | 1 |
| | | (d) | Ion exchanged water | Balance | Balance | Balance | Balance | Balance |
| | | | Total | 100 | 100 | 100 | 100 | 100 |
| | | | (p1 + p2) of component (a) | 18 | 18 | 18 | 18 | 21 |
| | | | q1 of component (a) | 6 | 0 | 2 | 2 | 0 |
| | | | p1/(p1 + p2) of component (a) | 0.5 | 1.0 | 0 | 1.0 | 1.0 |
| | | | p1 + p2 + q1 of component (a) | 24 | 18 | 20 | 20 | 21 |
| | | | Proportion of (a-i) component in component (a) (% by mole) | 74 | 100 | 3 | 98 | 100 |
| | | | Proportion of (a-ii) component in component (a) (% by mole) (a-ii) | 65 | 100 | 97 | 3 | 100 |
| | | | (a) + (b) (mass %) | 69.5 | 69.5 | 69.5 | 69.5 | 69.5 |
| | | | (a)/(b) (mass ratio) | 50/19.5 | 50/19.5 | 50/19.5 | 50/19.5 | 50/19.5 |
| | | | (1) Evaluation of detergency | X | ◎ | ◎ | ◎ | ◎ |
| | | | (2) Evaluation of storage stability | ○ | X | X | X | X |
| | | | (3) Model evaluation of solubility | ○ | X | X | ○ | X |
| | | | | — | XX | XX | — | XX |

(Note)

The components in the table are as follows. In the table, (a'-1) to (a'-6) were also considered to be component (a) and expressed by structures and amount ratios.

Component (a):

(a-1): Compound obtained by block adding 9 moles in average of EO, 2 moles in average of PO and 9 moles in average of EO in this order to a primary alcohol with from 10 to 14 carbon atoms.

(a-1) means a compound obtained by adding 9 moles of ethylene oxide to 1 mole of a primary alcohol having from 10 to 14 carbon atoms, then adding 2 moles of propylene oxide and then adding 9 moles of ethylene oxide. It means also a compound of formula (I) in which p1 = 9, q1 = 2 and p2 = 9. This interpretation is applied also to (a-2) to (a-6) below shown. This interpretation is applied also to (a'-1) to (a'-7) below shown.

(a-2): Compound obtained by block adding 7 moles in average of EO, 2 moles in average of PO and 7 moles in average of EO in this order to a primary alcohol with from 10 to 14 carbon atoms (a-3): Compound obtained by block adding 25 moles in average of EO, 2 moles in average of PO and 25 moles in average of EO in this order to a primary alcohol with from 10 to 14 carbon atoms (a-4): Compound obtained by block adding 4 moles in average of EO, 2 moles in average of PO and 14 moles in average of EO in this order to a primary alcohol with from 10 to 14 carbon atoms (a-5): Compound obtained by block adding 14 moles in average of EO, 2 moles in average of PO and 4 moles in average of EO in this order to a primary alcohol with from 10 to 14 carbon atoms (a-6): Compound obtained by block adding 9 moles in average of EO, 2 moles in average of PO and 9 moles in average of EO in this order to a secondary alcohol with from 12 to 14 carbon atoms (a'-1): Compound obtained by block adding 9 moles in average of EO, 2 moles in average of PO and 6 moles in average of EO in this order to a secondary alcohol with from 12 to 14 carbon (a'-2): Compound obtained by block adding 30 moles in average of EO, 2 moles in average of PO and 30 moles in average of EO in this order to a secondary alcohol with from 12 to 14 carbon (a'-3): Compound obtained by block adding 9 moles in average of EO, 6 moles in average of PO and 9 moles in average of EO in this order to a secondary alcohol with from 12 to 14 carbon (a'-4): Compound obtained by adding 18 moles in average of EO to a primary alcohol with from 10 to 14 carbon atoms (a'-5): Compound obtained by block adding 2 moles in average of PO and 18 moles in average of EO in this order to a primary alcohol with from 10 to 14 carbon atoms (a'-6): Compound obtained by block adding 18 moles in average of EO and 2 moles in average of PO in this order to a primary alcohol with from 10 to 14 carbon atoms (a'-7): Compound obtained by block adding 21 moles in average of EO to a primary alcohol with from 10 to 14 carbon atoms SOFTANOL 30 (a trade name): Compound obtained by adding 3 moles in average of EO to a secondary alcohol with from 12 to 14 carbon atoms, manufactured by Nippon Shokubai Co., Ltd.

Component (b):

(b-1): Linear alkyl benzenesulfonic acid with from 10 to 14 carbon atoms

TABLE 3-continued (b-2): Polyoxyethylene alkyl ether sulfuric acid ester salt (linear alkyl with from 10 to 14 carbon atoms, EO average addition molar number: 3, monoethanolamine salt, provided that the concentration shown in Table is a concentration of an acid type and a counter salt of monoethenol amine is added to (f) component)
(b-3): Polyoxyethylene alkyl ether sulfuric acid ester salt (linear alkyl with from 10 to 14 carbon atoms, EO average addition molar number: 2, monoethanolamine salt, provided that the concentration shown in Table is a concentration of an acid type and a counter salt of monoethenol amine is added to (f) component)
(b-4): LUNAC L-55 (a trade name) (coconut oil based fatty acid, manufactured by Kao Corporation)
Component (c):
(c-1): Diethylen glycol monobutyl ether (same as buthoxy diglycol)
(c-2): Propylene glycol
(c-3): Triethylene glycol phenyl ether
(c-4): Ethanol
(Others)
Polymer (1): Polymer compound synthesized by the method of Synthesis Example 1 in paragraph 0020 on page 4 of JP-A-10-60476
Fluorescent dye: TINOPAL CBS-X (a trade name) (manufactured by Ciba Specialty Chemicals)
Enzyme: EVALASE 16.0L-EX (a trade name) (protease, manufactured by Novozymes)
Coloring matter (1): Green No. 202

<Examples of Products>

(1) Product Example 1

The liquid detergent composition of the invention can be supplied as a product charged in a bag-shape container. One example thereof is shown below.

A self-standing-up bag, having width of 120 mm×height of 215 mm×folded width in bottom of 34.5 mm was formed with a laminated film including PET 12 μm/[ink layer+adhesive layer]/ONy 15 μm/adhesive layer/LLDPE 150 μm as film for a container. The bag was charged with 320 g of a liquid detergent composition of the present invention, for example, a composition of any of Example 1 to 12, was sealed at the top part by heat-sealing to obtain a pouch-packed liquid detergent, contained in a plastic container. The pouch-packed liquid detergent, contained in a plastic container sells commercially for repacking.

(2) Product Example 2

The liquid detergent composition of the invention is available in the form of a filled container having a bottle, a lid attached in an opening of the bottle and optionally a lid having an amount-measuring function. One example thereof is shown below.

400 g of a liquid detergent composition of the present invention, for example, a composition of any of Example 1 to 12, is introduced into a cylindrical bottle, as a container, having 438 mL of a filled capacity, 61 mm of the maximum outer diameter, 59 mm of an outer diameter of the body, 190 mm of a height and 0.5 mm of an average thickness of the body's wall, manufactured from PET resin containing 1.0 mass % of titanium oxide, having a modulus of elasticity in flexure (JIS K7171) of 2400 MPa and light transmittance of wavelengths 600 to 700 nm of 10% or less. After the bottle is filled by the liquid detergent composition, a principal lid, preliminarily screwed up by a lid (26 ml in volume) for measuring dosage, is engaged with the bottle to obtain a container containing a liquid detergent composition charged in a sealed plastic container.

The invention claimed is:

1. A method of washing a fabric product, comprising applying to an object to wash a liquid detergent composition comprising the following components (a), (b), (c) and (f), wherein the total sum of contents of component (a) and component (b) is from 50 to 90% by mass in terms of [(a) +(b)], and a mass ratio of component (a) to component (b) is from 25/75 to 90/10 in terms of (a)/(b); and wherein the pH value of the liquid detergent composition is 8 to 10 measured at 25° C. according to JIS K 3362:1998:

Component (a): from 15 to 75% by mass of a nonionic surfactant obtained by a process comprising adding pl moles of ethylene oxide to a compound represented by R—OH, wherein R represents an alkyl group or an alkenyl group with from 8 to 18 carbon atoms, then adding q 1 moles of an alkylene oxide with from 3 to 5 carbon atoms and further adding p2moles of ethylene oxide, wherein p1 represents a number of from 3 to 30, q1 represents a number of from 1 to 5, (p1+p2) is from 14 to 50, and p1/(p1+p2) is from 0.2 to 0.8;

Component (b): an anionic surfactant;

Component (c): from 5 to 40% by mass of a water-miscible organic solvent; and

Component (f): from 0.5 to 8% by mass of an alkaline agent.

2. The method according to claim 1, wherein component (a) is a nonionic surfactant having p1/(p1+p2) is from 0.3 to 0.7.

3. The method according to claim 1, wherein the alkylene oxide with from 3 to 5 carbon atoms is propylene oxide.

4. The method according to claim 1, wherein R represents a linear alkyl group.

5. The method according to claim 1, wherein the component(a) is a nonionic surfactant having (p1+p2) of from 16 to 50.

6. The method according to claim 1, which further comprises, as component (d), water in the amount of from 5 to 40% by mass.

7. The method according to claim 1, wherein component (f) is in the amount of 1 to 7% by mass.

8. The method according to claim 1, wherein component (f) is an alkanolamine.

9. The method according to claim 8, wherein the alkanolamine of component (f) is monoethanolamine.

10. The method according to claim 1, wherein the water-miscible organic solvent is at least one selected from the group consisting of (c1) to (c6):

(c1) an alkanol, (c2) an alkylene glycol having 2 to 6 carbon atoms and glycerine, (c3) a polyalkylene glycol having an alkylene glycol unit having 2 to 4 carbon atoms, (c4) (poly)alkylene glycol (mono- or di-)alkyl ether, composed of (poly)alkylene glycol having alkylene glycol unit having 2 to 4 carbon atoms and alkanol having 1 to 5carbon atoms, (c5) an alkylglyceryl ether having a C1 to C8 alkyl and (c6) an aromatic ether of (poly)alkylene glycol having alkylene glycol unit having 2 to 3 carbon atoms.

11. The method according to claim 1, wherein gelation is not caused in a step of diluting the composition with water at 5° C. within the range exceeding 0 time and up to 100 times at a temperature of the composition of from 5 to 40° C.

12. The method according to claim 6, wherein gelation is not caused in a step of diluting the composition with water at 5° C. within the range exceeding 0 time and up to 100 times at a temperature of the composition of from 5 to 40° C.

13. The method according to claim 1, wherein the viscosity of the liquid detergent composition at 20° C. is from 10 to 500 mPas.

14. The method according to claim 1, wherein the liquid detergent composition can be applied to water at 5° C.

15. The method according to claim 6, wherein the component (a) is a nonionic surfactant having (p1+p2) of from 16 to 50.

16. The method according to claim 1, wherein said fabric product is clothes.

* * * * *